US006227887B1

(12) United States Patent
Choy

(10) Patent No.: US 6,227,887 B1
(45) Date of Patent: May 8, 2001

(54) CARD EDGE CONNECTOR WITH EJECTOR THEREOF

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/465,505

(22) Filed: Dec. 16, 1999

(51) Int. Cl.[7] ..... H01R 13/62
(52) U.S. Cl. ..... 439/160; 439/485
(58) Field of Search ..... 439/325–328, 439/485, 160, 159, 61, 631

(56) References Cited

U.S. PATENT DOCUMENTS 5,634,803 * 6/1997 Cheng et al. ..... 439/160
5,672,069 * 9/1997 Cheng et al. ..... 439/160

* cited by examiner

*Primary Examiner*—Gary F. Paumen
(74) *Attorney, Agent, or Firm*—Wei Te Chung

(57) ABSTRACT

A card edge connector (1) including an insulative housing (10) defining a central slot (12) therein in a longitudinal direction with a plurality of contacts by two sides of the slot (12). A pair of towers (14) are positioned at two opposite ends of the housing (12). An ejector (16) is rotatably received within each tower (14). The ejector (16) includes a main body (26), with a kicker (28) at the bottom and a locker (30) at the top. A U-shaped retention wall (18) is formed on each tower (14) around the ejector (16). The retention wall (18) includes an end wall (20) bridging a pair of opposite side walls (22). Each said wall (22) defining a recess (24) extending therethrough in a lateral direction of the housing (10). A daughter board (100) defines an upper notch (102) and a lower notch (104) in each side portion (106). The recess (24) is aligned with the lower notch (104) when the daughter board (100) is fully embedded within the housing (10) so as to facilitating ventilation thereof when a plurality of connectors (1) and their associated daughter boards (100) are densely side by side positioned on a common mother board.

1 Claim, 8 Drawing Sheets

CARD EDGE CONNECTOR WITH EJECTOR THEREOF

BACKGROUND OF THE INVENTION

1. Field of The Invention

The invention relates to card edge connectors, and particularly to the card edge connectors each with ejectors at two opposite ends and commonly with one another in a side-by-side dense arrangement mounted on a printed circuit board.

2. The Prior Art

U.S. Pat. No. 5,634,803 discloses a DIMM (Dual In-line Memory Module) connector which is essentially a card edge connector with ejectors at two opposite ends. The ejector is rotatably mounted to the housing with a locking on the upper portion for latchably engaged within a notch in a side portion of the inserted daughter board. In application, multiple DIMMs are used on a limited area of the single mother board, thus requiring side-by-side dense arrangement thereof. Also, recently because the daughter board may be loaded with more heavy electronic components thereon and is required to endure more server condition when testing, the daughter board is modified to form two notches in each side portion thereof to cooperate with the two corresponding upper and lower lockers formed on each ejector for double retention between the DIMM and the daughter board and resisting the server vibration situation, thus assuring reliability of the whole assembly.

Anyhow, the heat generated by the daughter boards and accumulated around the side by side densely arranged DIMMs may be a problem for signal transmission. Rather than using an fan directing to the DIMMS, an economic design in the DIMM connector is desired to somewhat eliminate heat problem.

SUMMARY OF THE INVENTION

According to an aspect of the invention, a card edge connector including an insulative housing defining a central slot therein in a longitudinal direction with a plurality of contacts by two sides of the slot. A pair of towers are positioned at two opposite ends of the housing. An ejector is rotatably received within each tower. The ejector includes a main body, with a kicker at the bottom and a locker at the top. A U-shaped retention wall is formed on each tower around the ejector. The retention wall includes an end wall bridging a pair of opposite side walls. Each said wall defining a recess extending therethrough in a lateral direction of the housing. A daughter board defines upper and lower notches in each side portion. The recess is aligned with the lower notch when the daughter board is fully embedded within the housing so as to facilitating ventilation thereof when a plurality of connectors and their associated daughter board are densely side by side positioned on a common mother board.

DETAILED DESCRIPTION OF THE PREFERRED EMBODIMENT

Figure 1:
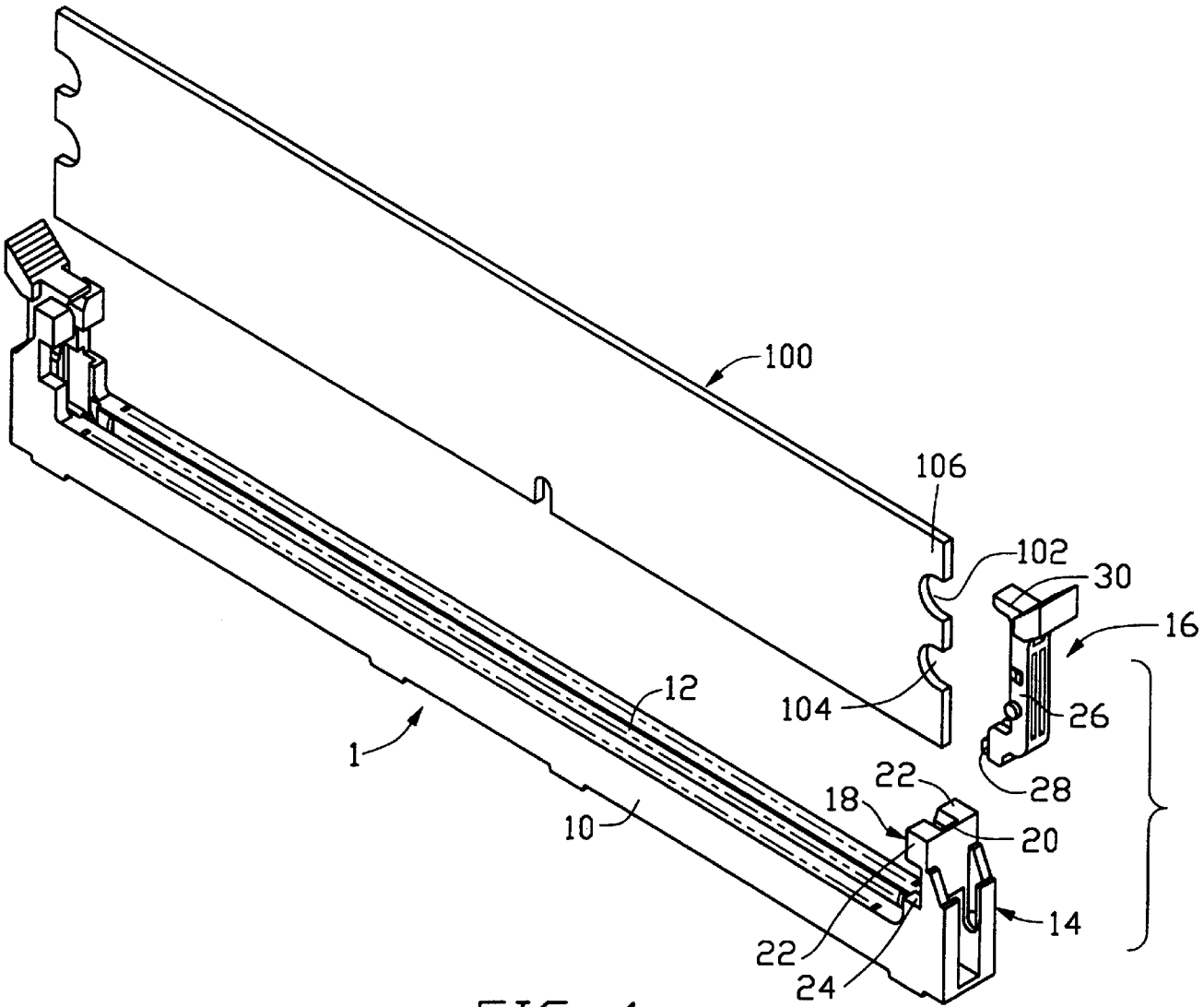
FIG. 1 is an exploded perspective view of a DIMM connector and the associated daughter board according to the invention.
Figure 2:
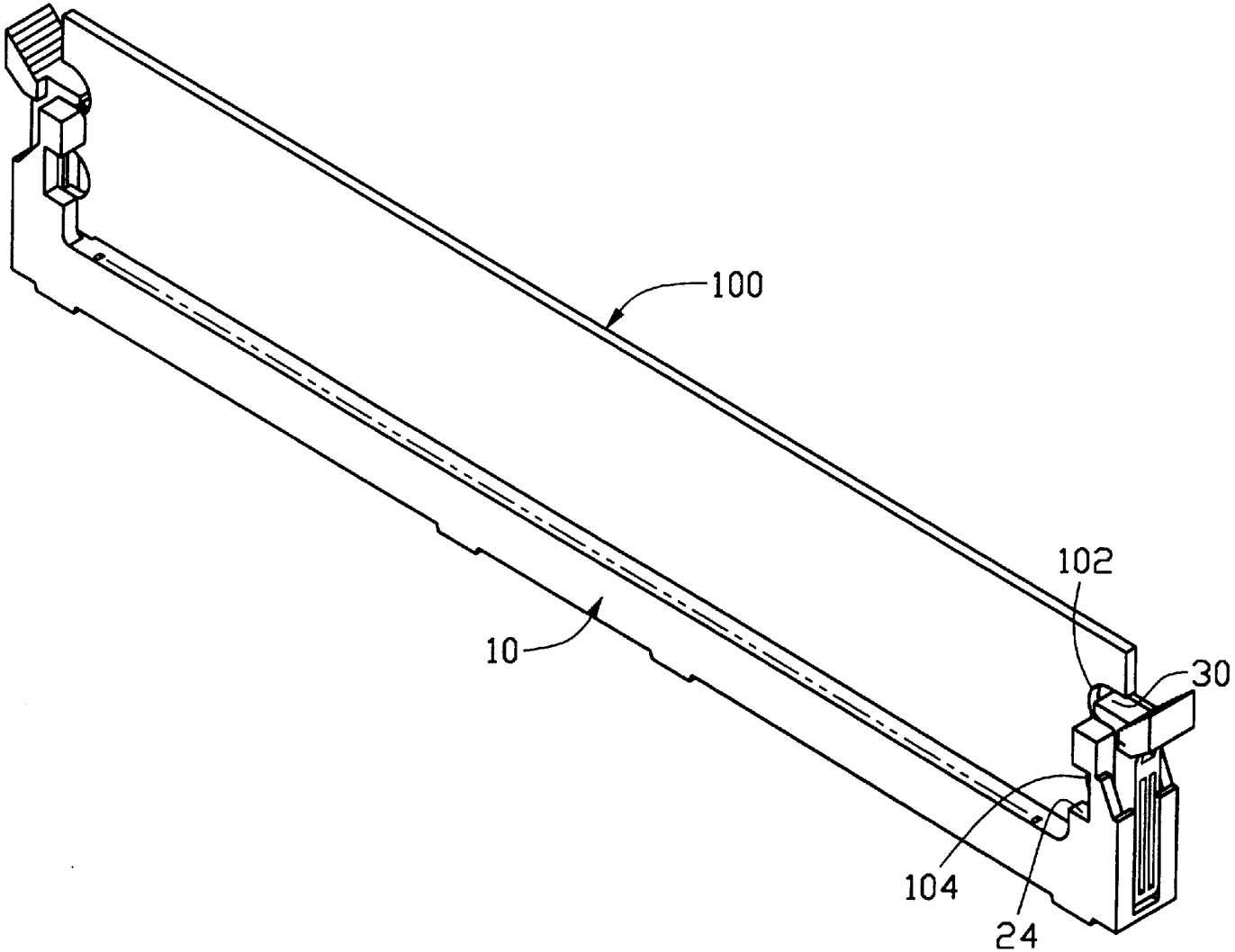
FIG. 2 is a perspective view of the DIMM connector and the associated daughter board assembled with each other of FIG. 1.
Figure 3:
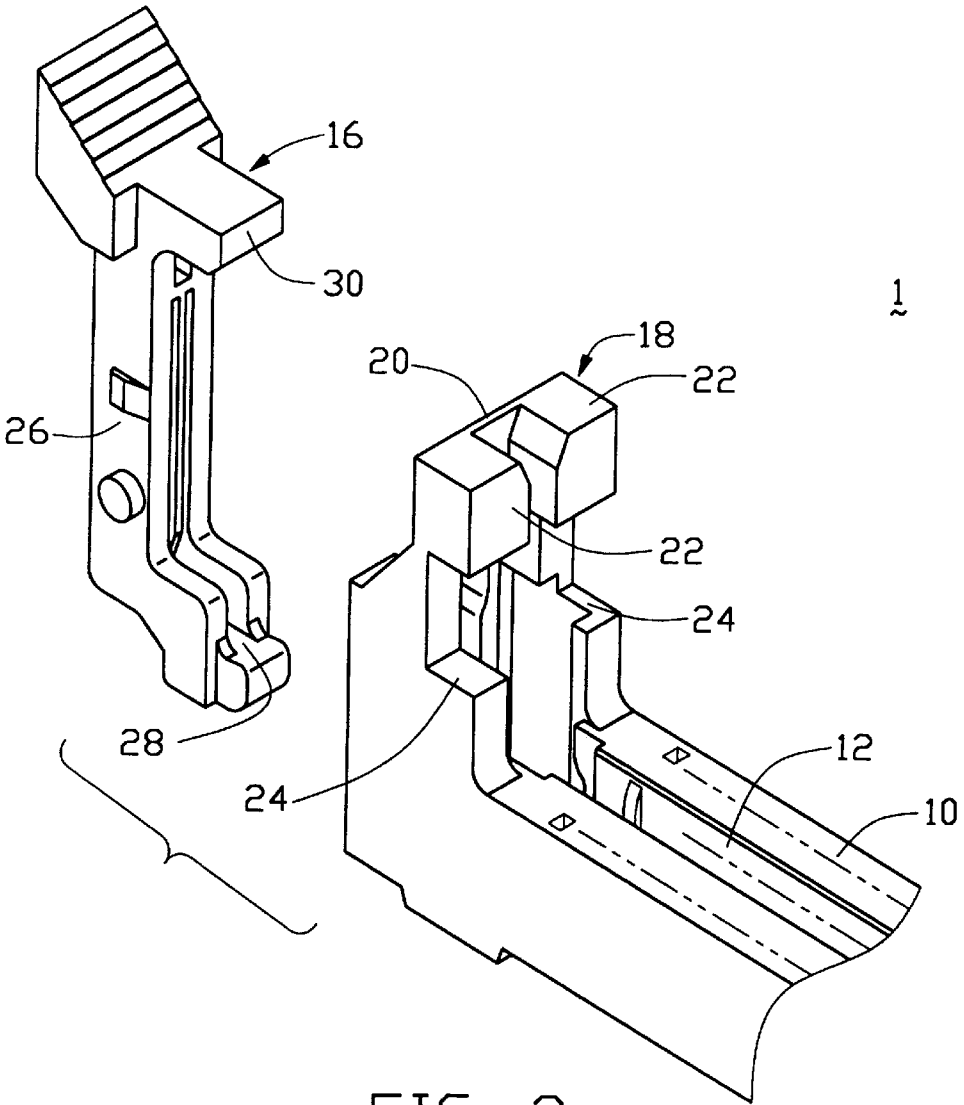
FIG. 3 is a partially enlarged exploded perspective view of the housing and the ejector of the connector of FIG. 1.
Figure 4:
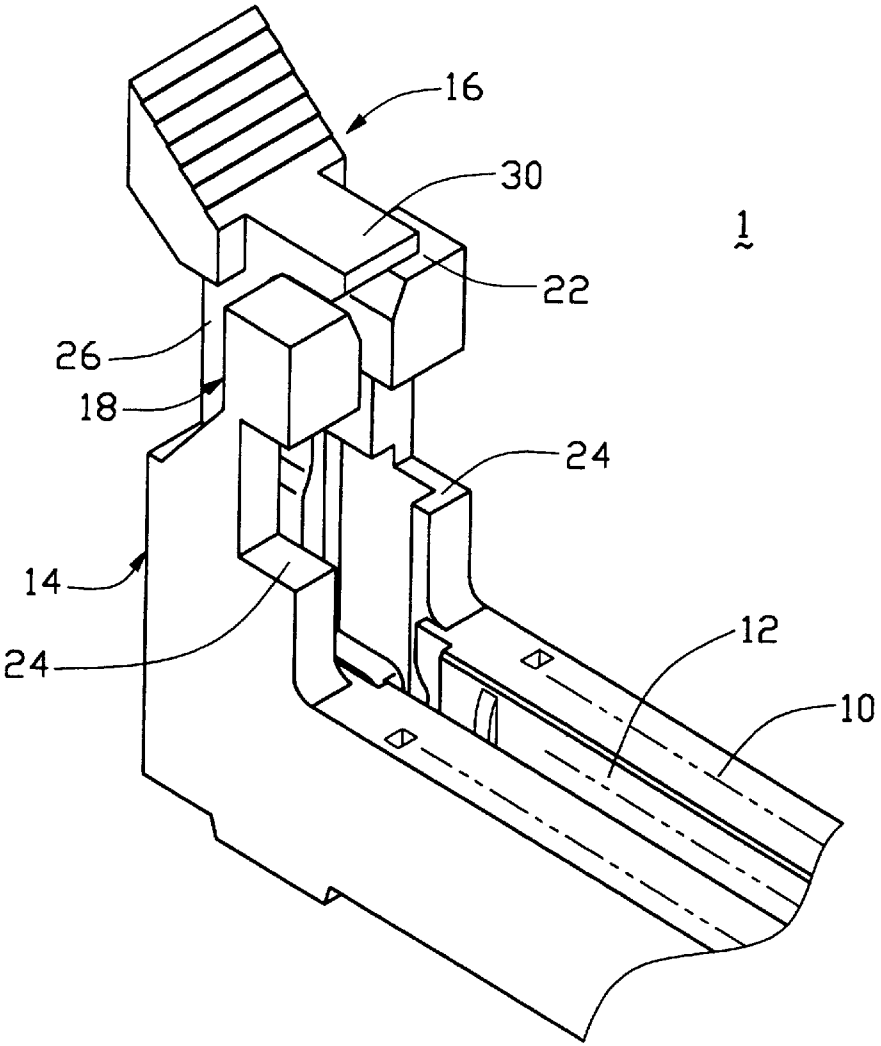
FIG. 4 is a partially enlarged perspective view of the assembled housing and ejector of the connector of FIG. 1.
Figure 5:
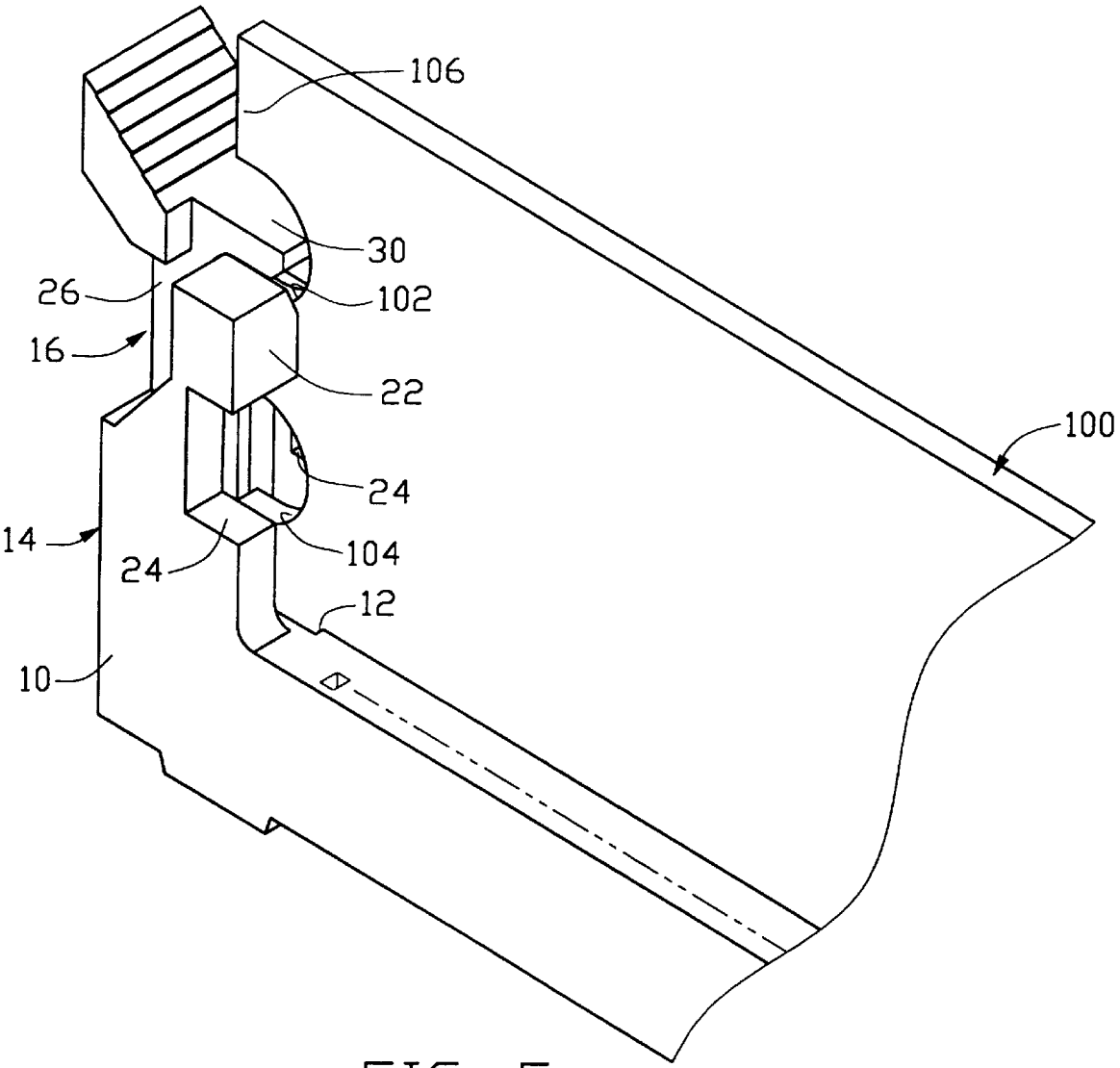
FIG. 5 is a partially enlarged perspective view of the assembled connector and associated daughter board of FIG. 2.

Referring to FIGS. 1–5, the DIMM connector 1 includes an insulative housing 10 defining a central slot 12 along a longitudinal direction thereof with a plurality of contacts (not shown) positioned by two sides of the slot 12. A pair of towers 14 are located at two opposite ends of the housing 10. An ejector 16 is rotatably received within each tower 14. A U-shaped retention wall 18 is formed on each tower 14. The U-shaped retention wall 18 defines an end wall 20 bridging a pair of side walls 22. A recess 24 is formed in each side wall 22 at a predetermined height. The ejector 16 includes a main body 26 with a kicker 28 at the bottom and a locker 30 at the top thereof.

A daughter board 100 defines an upper notch 102 and a lower notch 104 on each side portion 106.

When assembled, two side portions 106 of the daughter board 100 is retainably received between the retention walls 18 of the housing 10, a bottom portion of the daughter board 100 is fully embedded within the slot 12, the locker 30 is latchably engaged within the upper notch 102, and the recesses 24 in each pair of side walls 22 are aligned with the corresponding lower notch 104 in a lateral direction of the housing 10.

Figure 6:
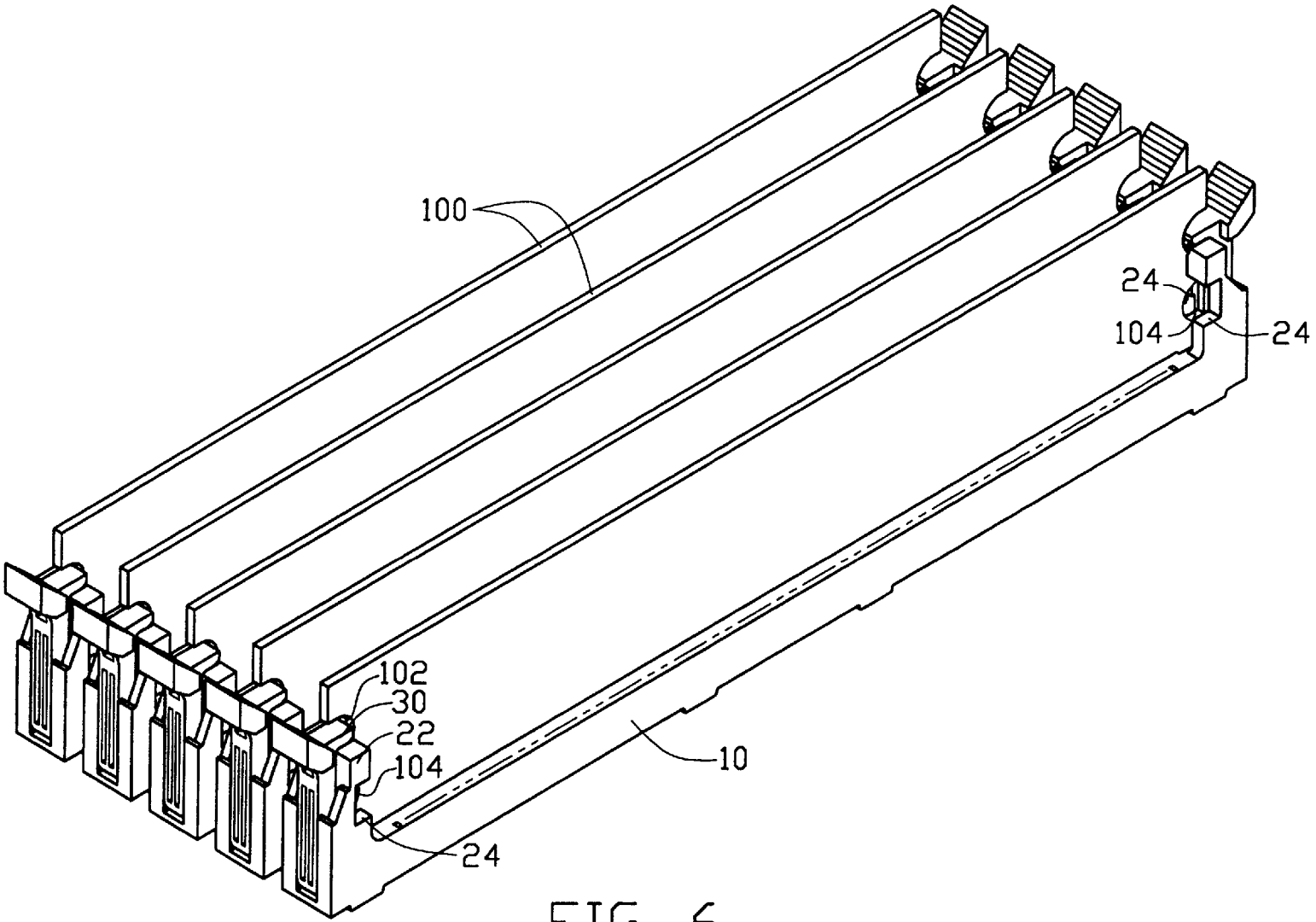
FIG. 6 is a perspective view of a plurality of connectors and the associated assembled daughter boards of FIG. 1 which are side by side densely arranged with one another.
Figure 7:
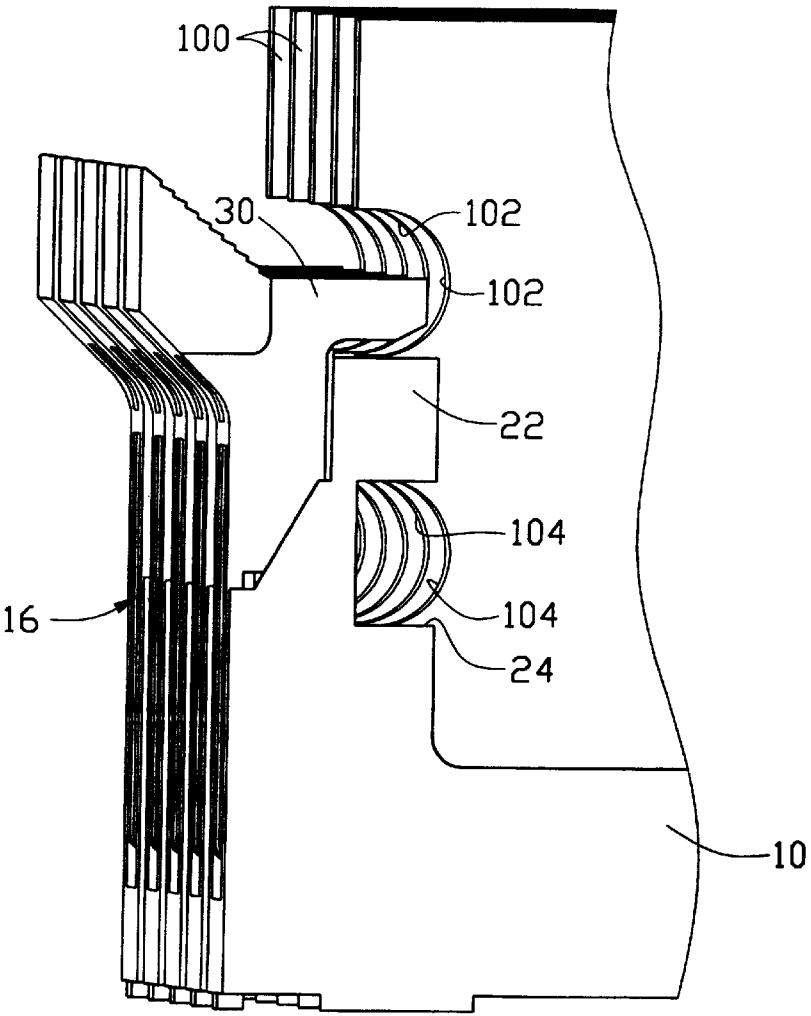
FIG. 7 is a partially enlarged perspective view of the plurality of connectors and associate daughter boards of FIG. 6 to show how the recesses of the connectors and the corresponding lower notches of the daughter boards are aligned with one another.
Figure 8:
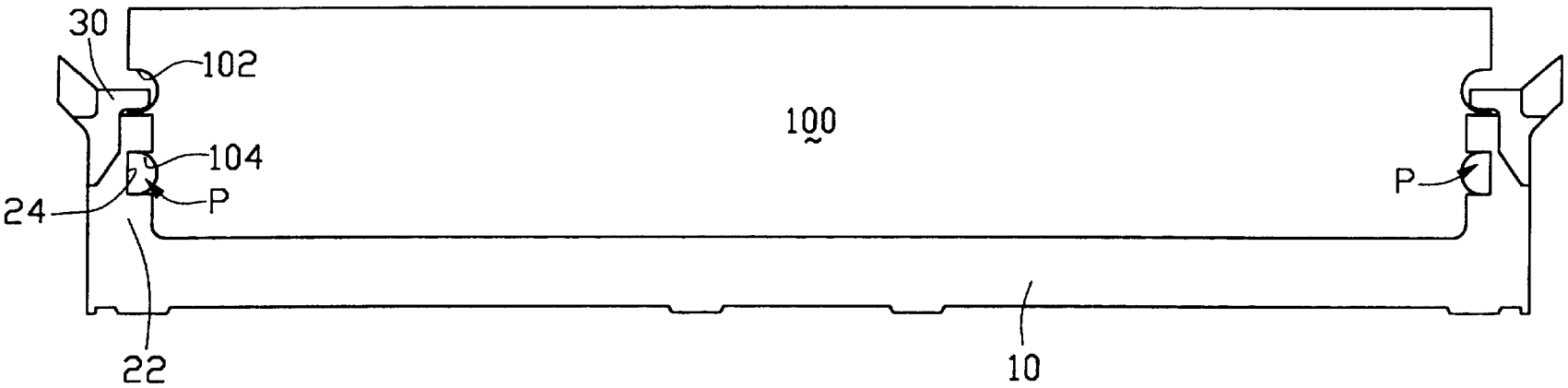
FIG. 8 is a plan view of the connectors and the daughter boards of FIG. 7 to show the ventilation effect thereof.

Referring to FIGS. 6–8, a plurality of assembled connectors 1 and associated daughter boards 100 are densely side by side arranged with one another wherein a passage P is formed along the recesses 24 and the lower notches 104 for ventilation purpose.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

I claim:

1. An electrical assembly comprising:

a plurality of connectors side by side arranged with one another, each connector including:

an insulative housing defining a central slot along a longitudinal direction thereof;

a pair of towers positioned at two ends of the housing;

a pair of side walls formed on each tower;

an ejector rotatably positioned at each tower;

at least a recess formed in one of said side walls and said ejector in a lateral direction of the housing; and a daughter board received in each of said connectors, each daughter board including a notch in a side portion thereof;

said ejector defining a main body with a kicker at a bottom portion thereof and a locker at an upper portion thereof; wherein said daughter board is assembled to the housing with a bottom portion of the daughter board being received within the central slot, the locker of the ejector is latchably engaged with the daughter board, and the recess is aligned with the corresponding notch in a lateral direction of the housing so as to form a passage across the connectors and the associated daughter boards for ventilation purpose.

* * * * *